US010029824B2

(12) United States Patent
Meers et al.

(10) Patent No.: US 10,029,824 B2
(45) Date of Patent: Jul. 24, 2018

(54) STACKABLE LOW DEPTH TRAY

(71) Applicant: Rehrig Pacific Company, Los Angeles, CA (US)

(72) Inventors: Ryan C. Meers, West Chester, PA (US); William P. Apps, Alpharetta, GA (US); Margaret McCanless, Lawrenceville, GA (US)

(73) Assignee: REHRIG PACIFIC COMPANY, Los Angeles, CA (US)

( * ) Notice: Subject to any disclaimer, the term of this patent is extended or adjusted under 35 U.S.C. 154(b) by 582 days.

(21) Appl. No.: 14/054,012

(22) Filed: Oct. 15, 2013

(65) Prior Publication Data

US 2014/0110303 A1 Apr. 24, 2014

Related U.S. Application Data

(60) Provisional application No. 61/713,700, filed on Oct. 15, 2012.

(51) Int. Cl.

| | |
|---|---|
| ***B65D 25/54*** | (2006.01) |
| ***B65D 71/70*** | (2006.01) |
| ***B65D 21/02*** | (2006.01) |

(52) U.S. Cl.

CPC ..... *B65D 25/54* (2013.01); *B65D 21/0213* (2013.01); *B65D 21/0215* (2013.01); *B65D 21/0233* (2013.01); *B65D 71/70* (2013.01)

(58) Field of Classification Search

CPC ..... B65D 21/0233; B65D 21/0215
USPC ..... 220/DIG. 2, DIG. 15, 669, 676, 509; 206/512, 518, 519, 520, 775, 511
See application file for complete search history.

(56) References Cited

U.S. PATENT DOCUMENTS

| | | | | | |
|---|---|---|---|---|---|
| 2,760,676 | A | * | 8/1956 | Knieriem et al. | 206/511 |
| 3,682,351 | A | * | 8/1972 | De Putter | 206/505 |
| D239,213 | S | * | 3/1976 | Carroll | D3/314 |
| RE29,262 | E | * | 6/1977 | Utz | 220/516 |
| 4,848,580 | A | * | 7/1989 | Wise | 206/519 |
| 5,078,282 | A | * | 1/1992 | Stanfield | 211/74 |
| D356,679 | S | * | 3/1995 | Apps et al. | D3/304 |
| 5,495,945 | A | * | 3/1996 | Apps et al. | 206/519 |
| 5,704,482 | A | * | 1/1998 | Apps et al. | 206/510 |
| 5,785,170 | A | * | 7/1998 | Hammett | 206/203 |
| D398,152 | S | * | 9/1998 | Kelly | D3/304 |
| 5,979,654 | A | * | 11/1999 | Apps | 206/507 |
| 6,073,793 | A | * | 6/2000 | Apps et al. | 220/509 |
| 6,186,328 | B1 | * | 2/2001 | Apps | 206/518 |
| 6,401,960 | B1 | * | 6/2002 | Hammett | 220/516 |
| 6,457,599 | B1 | * | 10/2002 | Apps et al. | 220/509 |
| 6,749,065 | B1 | * | 6/2004 | Hammett | 206/509 |

(Continued)

*Primary Examiner* — Andrew T Kirsch
*Assistant Examiner* — Jennifer Castriota
(74) *Attorney, Agent, or Firm* — Carlson, Gaskey & Olds, P.C.

(57) ABSTRACT

A crate includes a base, a pair of opposed end walls extending upward from the base, and a pair of opposed side walls extending upward from the base between the end walls. Each side wall includes a plurality of side columns extending upward from the base to a side band. The side wall and the end wall include an upper band connected to the base by a plurality of columns. The upper band includes at least one upper window formed therethrough. The side wall includes an upper edge having a curved center peak, troughs on either side of the center peak and end peaks proximate either end wall.

13 Claims, 11 Drawing Sheets

(56) References Cited

U.S. PATENT DOCUMENTS

| | | | | |
|---|---|---|---|---|
| 7,011,215 | B2 * | 3/2006 | Meissen et al. | 206/557 |
| 7,086,531 | B2 * | 8/2006 | Apps et al. | 206/509 |
| 7,093,715 | B1 * | 8/2006 | Apps | 206/518 |
| 7,207,458 | B1 * | 4/2007 | Koefelda et al. | 220/519 |
| 7,694,839 | B2 * | 4/2010 | Koefelda et al. | 220/516 |
| 7,743,939 | B2 * | 6/2010 | Stahl | 220/518 |
| 8,056,753 | B2 * | 11/2011 | Koefelda et al. | 220/516 |
| 8,123,034 | B2 * | 2/2012 | Apps et al. | 206/519 |
| 2001/0019063 | A1 * | 9/2001 | Apps | 220/771 |
| 2003/0024844 | A1 * | 2/2003 | Hammett | 206/505 |
| 2010/0084297 | A1 * | 4/2010 | Apps | 206/427 |
| 2010/0147642 | A1 * | 6/2010 | Andochick | A45C 5/14 190/18 A |
| 2010/0170823 | A1 * | 7/2010 | Koefelda et al. | 206/505 |
| 2010/0258467 | A1 * | 10/2010 | Apps | 206/427 |
| 2011/0240659 | A1 * | 10/2011 | Orgeldinger | 220/608 |
| 2012/0152789 | A1 * | 6/2012 | Apps et al. | 206/519 |

* cited by examiner

STACKABLE LOW DEPTH TRAY

BACKGROUND

Injection-molded plastic beverage crates are used to ship beverage containers, such as plastic bottles, to stores. Often, it is intended that consumers will view the bottles in the store to make their selection and then remove the desired bottles from the crate.

Many known crates includes a base, a pair of opposed end walls extending upward from the base, and a pair of opposed side walls extending upward from the base between the end walls. Each side wall includes a plurality of side columns extending upward from the base to a side band.

SUMMARY

The present invention relates to crates for carrying bottles, particularly plastic beverage bottles. One example for multi-serving (e.g. 2 liter) bottles is disclosed. The crates are preferably injection molded as a single piece of plastic, such as HDPE or other suitable material.

The crate includes a base, a pair of opposed end walls extending upward from the base, and a pair of opposed side walls extending upward from the base between the end walls. Each side wall includes a plurality of side columns extending upward from the base to a side band. The side wall and the end wall include an upper band connected to the base by a plurality of columns. The upper band includes at least one upper window formed therethrough.

In the example embodiment, the side wall includes an upper edge having a curved center peak, troughs on either side of the center peak and end peaks proximate either end wall

BRIEF DESCRIPTION OF THE DRAWINGS

FIG. 4 is a top view of the crate.

DETAILED DESCRIPTION OF THE PREFERRED EMBODIMENT

Figure 1:
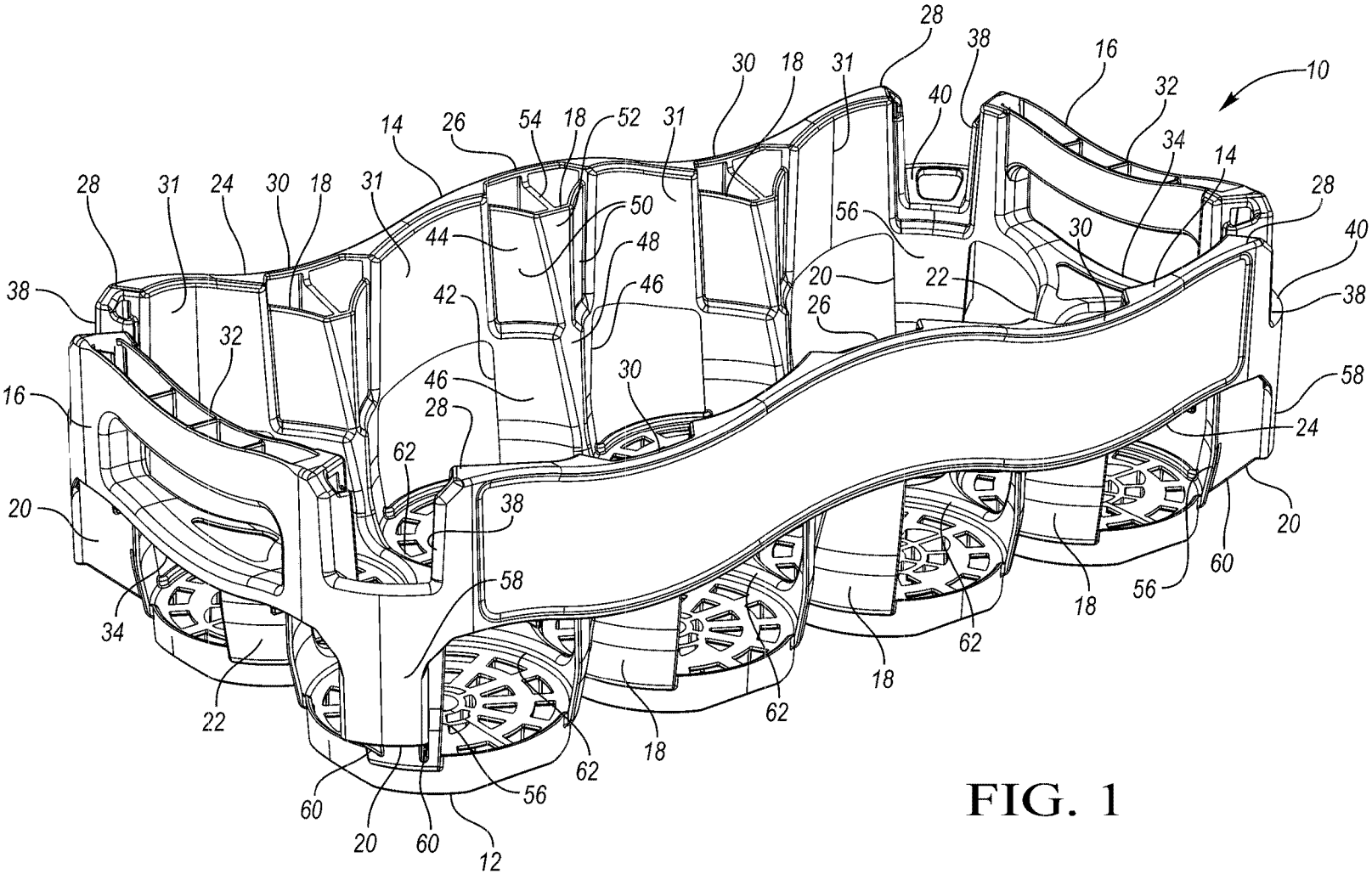
FIG. 1 is an upper perspective view of a crate according to one embodiment of the present invention.

The present invention relates to crate 10 for carrying bottles, particularly plastic beverage bottles, such as multi-severing (e.g. 2 liter) bottles. The crate 10 is preferably injection molded as a single piece of plastic, such as HDPE or other suitable material.

A crate 10 according to one embodiment of the present invention includes a base 12 including a plurality of circular platforms each defining a bottle support surface. A pair of side walls 14 extend upward from side edges of the base 12. End walls 16 extend upward from end edges of the base 12. Each side wall 14 includes a plurality of side columns 18 extending upward from the base 12. Corner columns 20 extend upward from corners of the base, while end columns 22 extend upward from ends of the base 12.

Each side wall 14 includes a side band 24 spaced upwardly from the base 12 and positioned along the outside of the side columns 18. Each side band 24 has a wavy shape, as shown. The side band 24 includes an upper edge having a curved center peak 26, troughs 30 on either side of the center peak 26 and end peaks 28 at either end of the side band 24. In this particular embodiment, the center peak 26 in each side band 24 are the two highest points in the crate 10, slightly higher than the end peaks 28 and the end walls 16. For one thing, this provides a relatively unstable surface for the crate 10 if the crate 10 were flipped over. This discourages theft of the crate 10, because it cannot be used as a stool, step or other support surface. The lower edge of the side band 24 is complementary to the upper edge of the side band 24, including recesses complementary to the peaks 26, 28 of the upper edge. The side bands 24 include concave interior walls 31 between the side columns 18. The wave side bands 24 are also decorative.

Each end wall 16 includes an upper handle portion 32 and a lower handle portion 34 extending between the corner columns 20. The upper handle portion 32 is spaced above the lower handle portion 34 to provide a handle opening. The end columns 22 extend upward from the base 12 to the lower handle portion 34. In this embodiment, the upper handle portion 32 is curved (i.e. curved generally in the plane of the end wall) such that the lower surface of the upper handle portion is convex, thereby providing a more comfortable surface for a user's hand. Further, having a concave upper surface of the upper handle portion 32 provides a similar design to the curved side bands 24. The radius of the curve of the upper surface of the upper handle portion 32 approximates the radius of the curves of the upper surface of the side bands 24.

Each corner column 20 includes a large upper window 38 therethrough (alternatively the upper window 38 can be considered a gap between the side band 24 and the end walls 16, above the corner column 20). A lower wall 40 of the corner column 20 partially defines the upper window 38. The lower wall 40 of the corner column 20 is angled downward into the crate 10. The corner windows 38 provide the ability for a barcode reader to scan the barcode on a bottle in one of the corner pockets of the crate 10. By angling the lower wall 40 downward, the amount of structure in the corner is maximized, while also exposing the entire barcode on the bottle.

Together, the side bands 24 and the upper and lower handle portions 32, 34 can be considered an upper band circumscribing the crate 10 and connected to the base 12 by columns 18, 20, 22. The upper window 38 could alternatively be formed through other locations in the upper band. For example, the upper window 38 could be formed as part of one of the side columns 18 through the side band 24 instead of as part of the corner columns 20.

Each of the side columns 18 includes a lower column portion 42 and an upper column portion 44. The lower column portion 42 is below the side band 24. The upper column portion 44 is formed on the interior of the side band 24. The lower column portion 42 includes a pair of angled, concave lower side walls 46 joined by a front wall 48. The upper column portion 44 includes a pair of angled, concave upper side walls 50 joined by an upper front wall 52. The upper side walls 50 are recessed (i.e., offset outward of the crate 10) relative to the lower side walls 46. A vertical interior rib 54 extends generally perpendicularly between the side band 24 and the upper front wall 52 of each side column 18. The upper edges of the interior rib 54, upper side walls 44 and upper front wall 52 all angle downward toward the interior of the crate 10.

Each corner column 20 includes an inner wall 56 extending downward from an inner edge of the lower wall 40 and an outer wall 58 extending downward from an outer edge of the lower wall 40. The outer wall 58 is spaced outwardly from the inner wall 56 and connected to the inner wall 56 by a pair of lateral walls 60. The lateral walls 60 angle toward one another as they extend from the outer wall 58 toward the inner wall 56. The lateral walls 60 also angle downward of the crate 10 as they extend from the outer wall 58 toward the inner wall 56.

A plurality of low profile dividers 62 extend upward from the base 12 between the circular platforms, thereby partially defining bottle receiving pockets.

Figure 2:
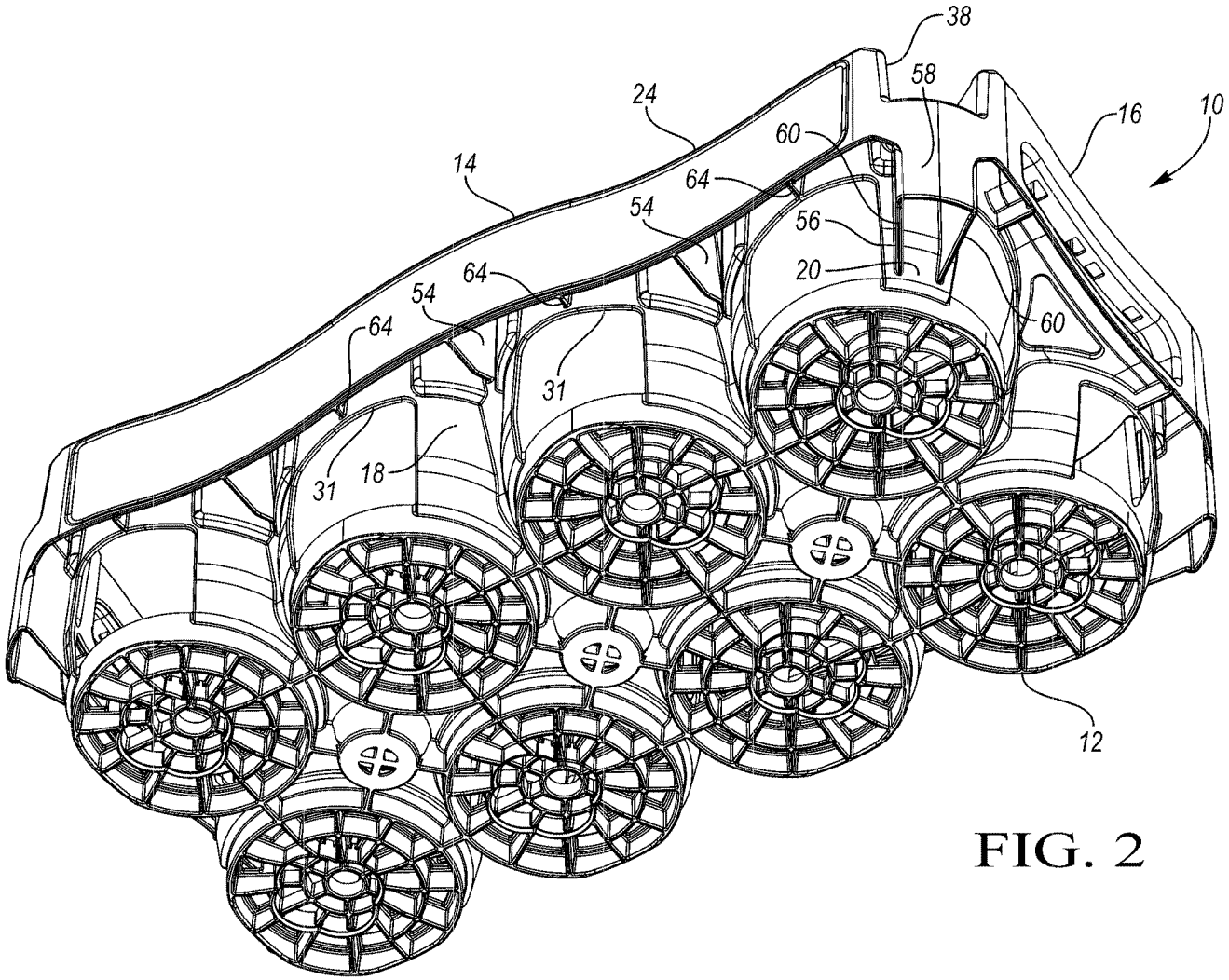
FIG. 2 is a bottom perspective view of a crate according to one embodiment of the present invention.

FIG. 2 is a bottom perspective view of the crate 10. As shown, the outer wall 58 and lateral walls 60 of the corner column 20 are aligned with the window 38. The interior rib 54 of each column 18 angles downward as it extends inward from the side band 24. Vertical ribs 64 join the side band 24 to the interior wall 31 between the columns 18.

Figure 3:
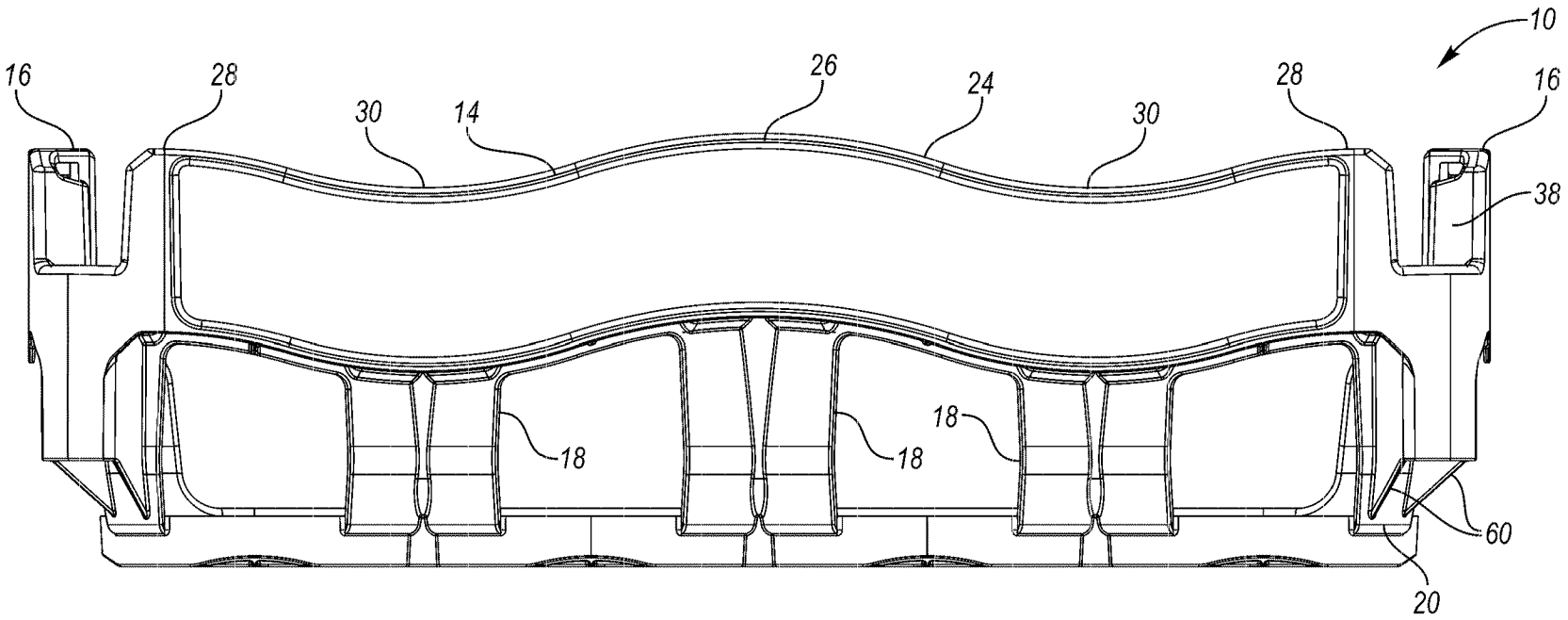
FIG. 3 is a side view of the crate.

FIG. 3 is a side view of the crate 10. As shown, the center peak 26 of the side band 24 is the highest point on the crate 10, slightly higher than the end peaks 28 of the side band 24 and higher than the end walls 16.

Figure 4:
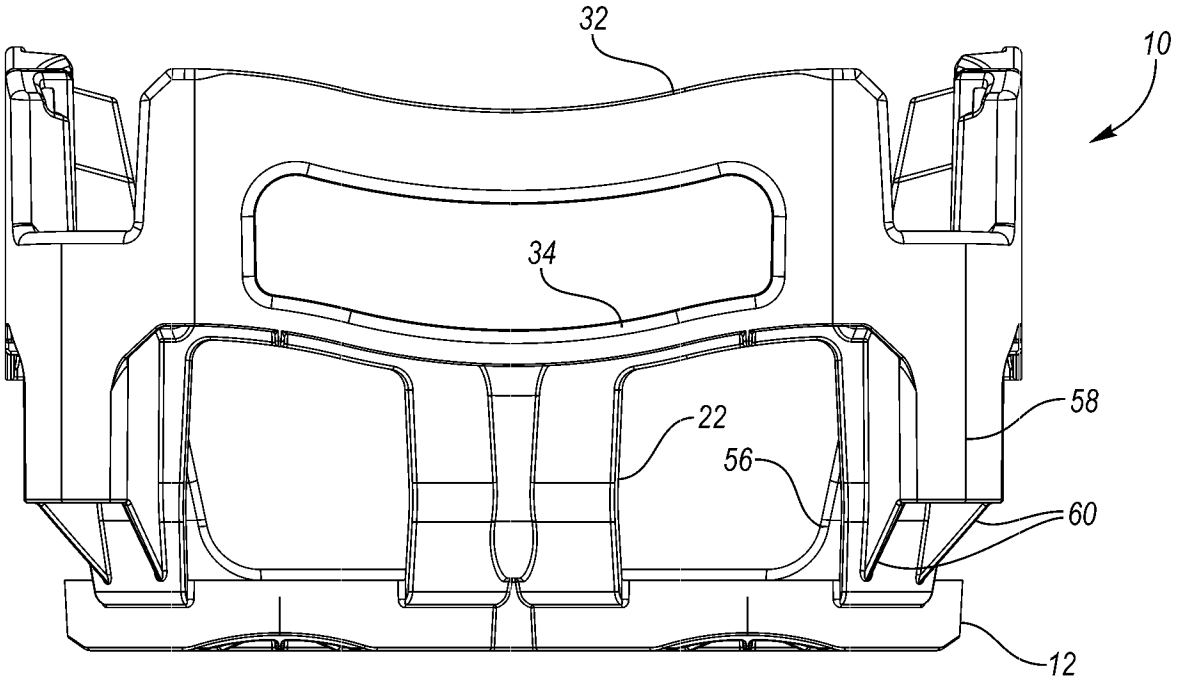
FIG. 4 is an end view of the crate.

FIG. 4 is an end view of the crate 10. As shown, the upper handle portion 32 and the lower handle portion 34 are both curved, opening upward. This provides the convex lower surface of the upper handle portion 32 for increased comfort.

Figure 5:
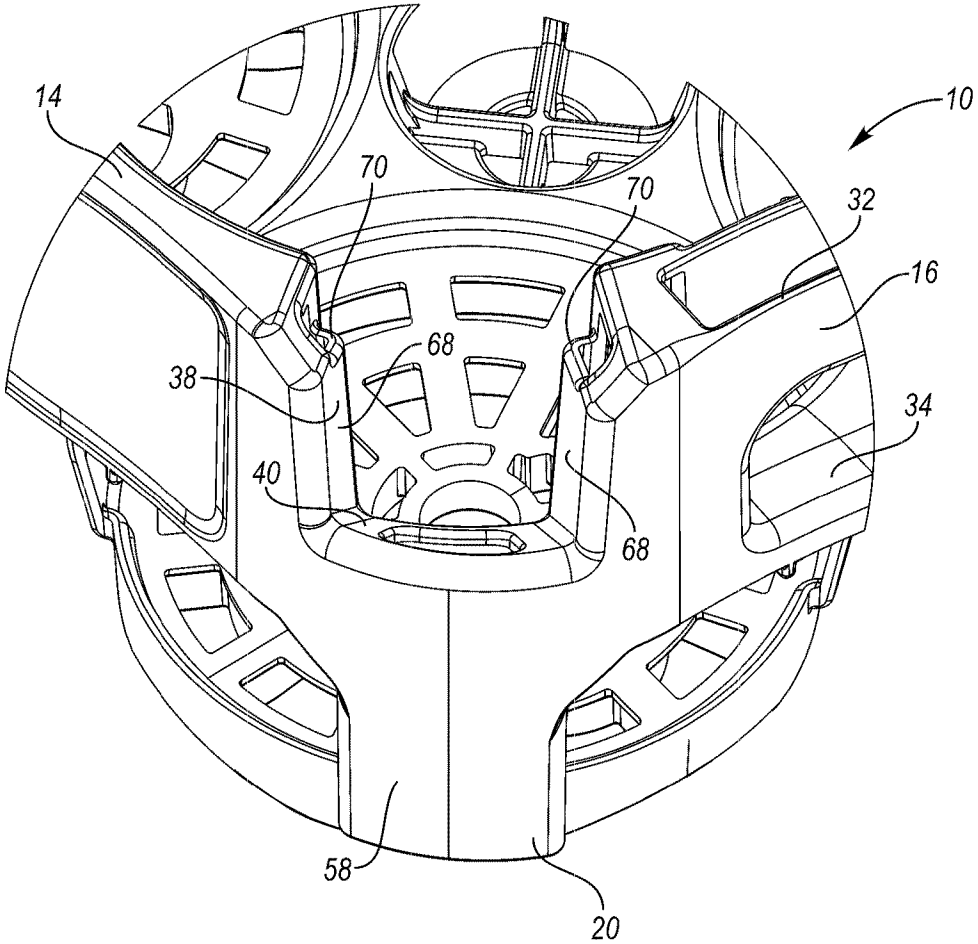
FIG. 5 is an enlarged exterior view of one corner of the crate.

FIG. 5 is an exterior view of one corner of the crate 10. The upper window 38 is defined by the lower wall 40 of the corner column 20 and by window walls 68. The window walls 68 are shorter than the end walls 16 and the side wall 14 defining an upper surface 70, lower than the side wall 14 and lower than the end wall 16.

Figure 6:
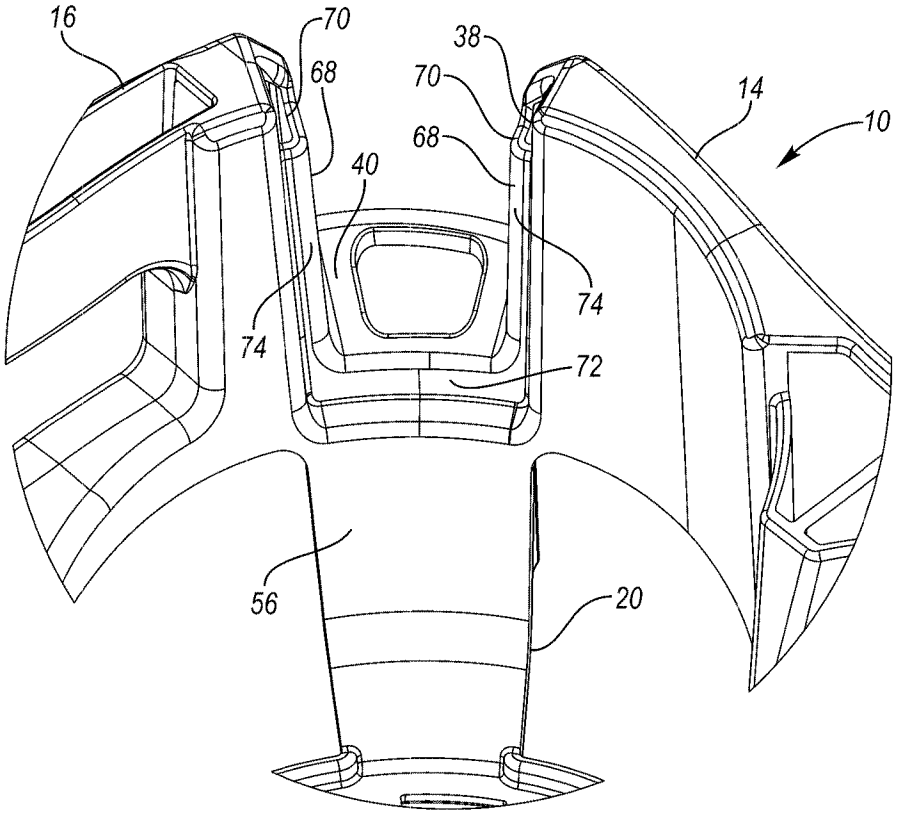
FIG. 6 is an enlarged interior view of the corner of FIG. 5.

FIG. 6 is an interior perspective view of the corner of FIG. 5. The lower wall 40 of the corner column 20 extends downward and inward of the crate 10 to a recessed front surface 72, recessed relative to the inner wall 56 of the corner column 20. Similarly, the window walls 68 extend inward of the crate 10 to recessed side walls 74, which are recessed outward relative to inner surfaces of the side wall 14 and end wall 16. As shown, the lower wall 40 of the corner column 20 may include a large opening.

Figure 7:
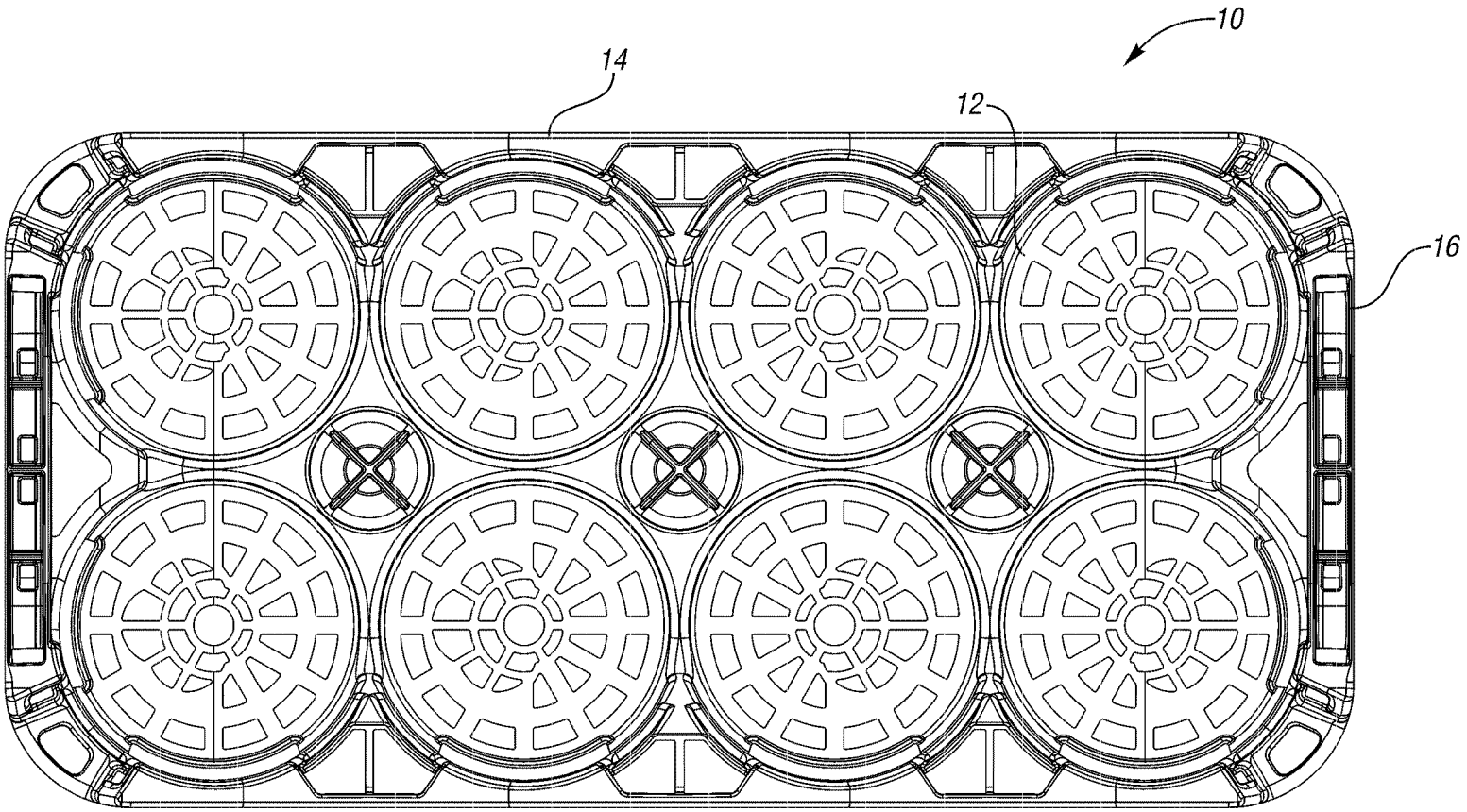
FIG. 7 is a top view of the crate.

FIG. 7 is a top view of the crate 10.

Figure 8:
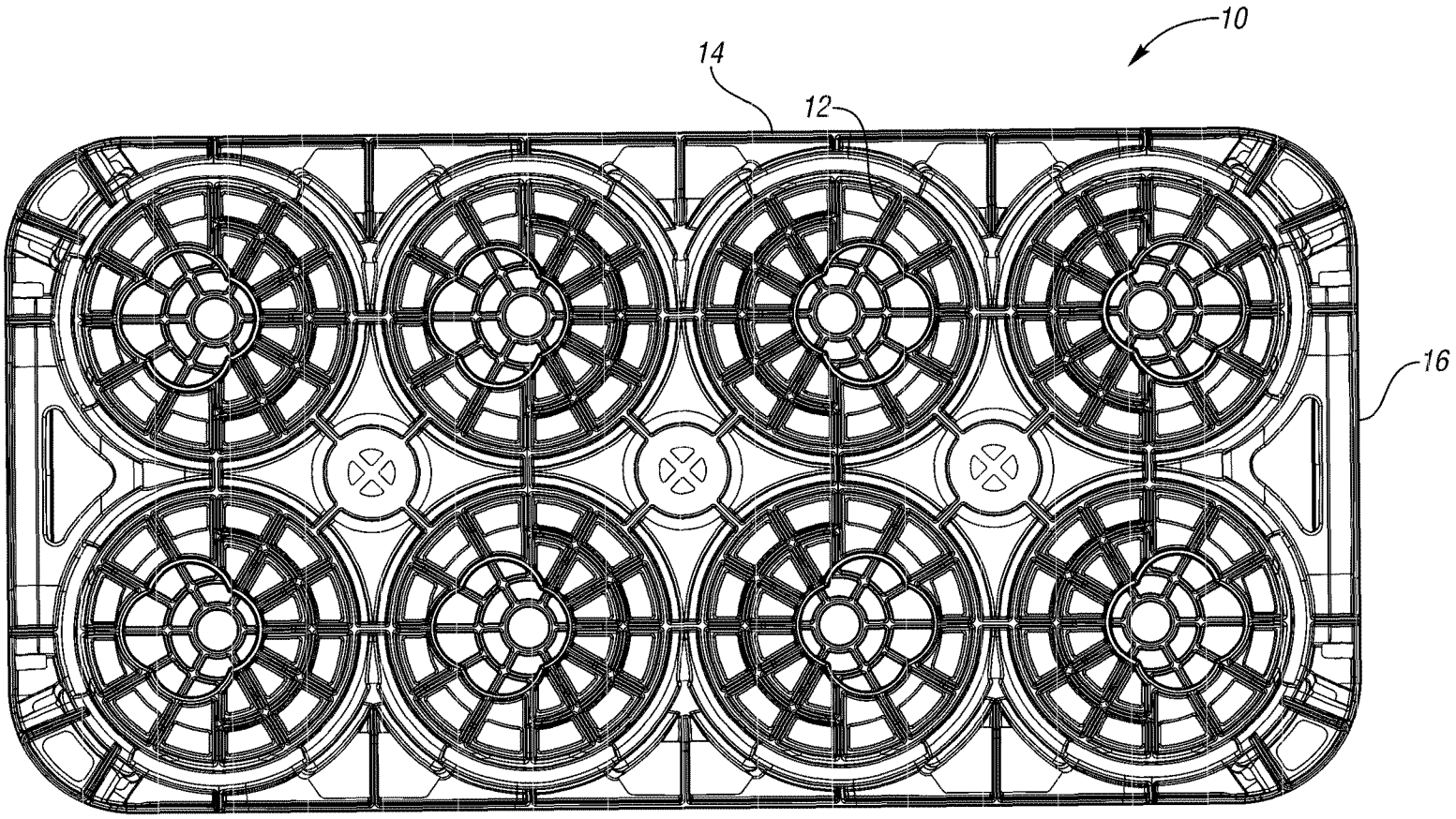
FIG. 8 is a bottom view of the crate.

FIG. 8 is a bottom view of the crate 10.

Figure 9:
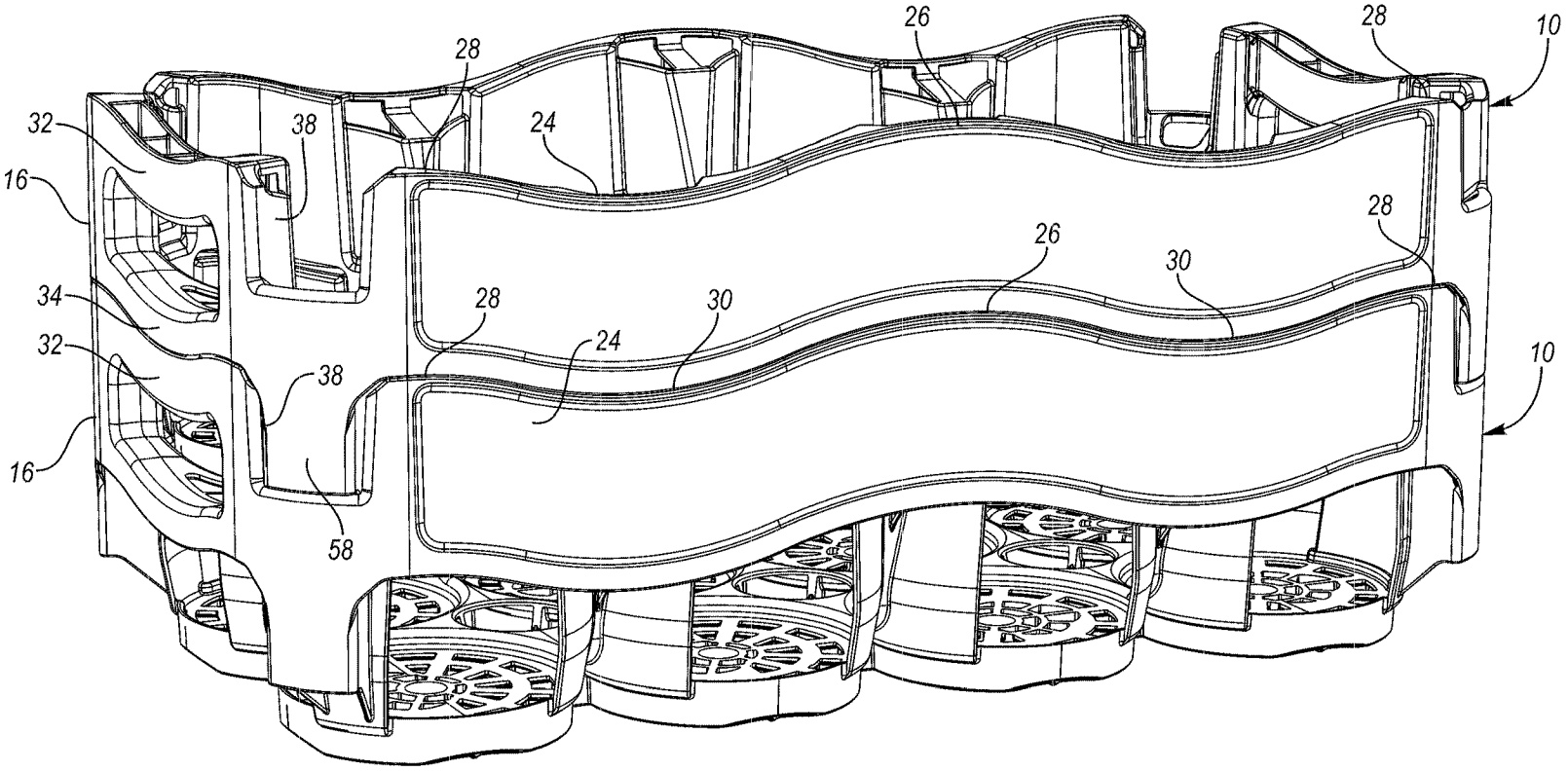
FIG. 9 is a perspective view showing the crate with an identical crate nested therein.

FIG. 9 is a perspective view showing the crate 10 with an identical crate 10 nested therein. As shown, the outer wall 58 and lateral walls 60 (lateral walls 60 not visible) of the upper crate are received in the upper window 38 in each corner of the crate 10. The peaks 26, 28 on the side band 24 of the lower crate 10 are received in complementary recesses on the lower edge of the side band 24 of the upper crate 10. The upper edge of the side band 24 of the lower crate 10 aligns with and mates with the lower edge of the side band 24 of the upper crate 10. Similarly the concave upper surface of the upper handle portion 32 of the lower crate 10 receives the lower convex surface of the lower handle portion 34 of the upper crate 10.

Figure 10:
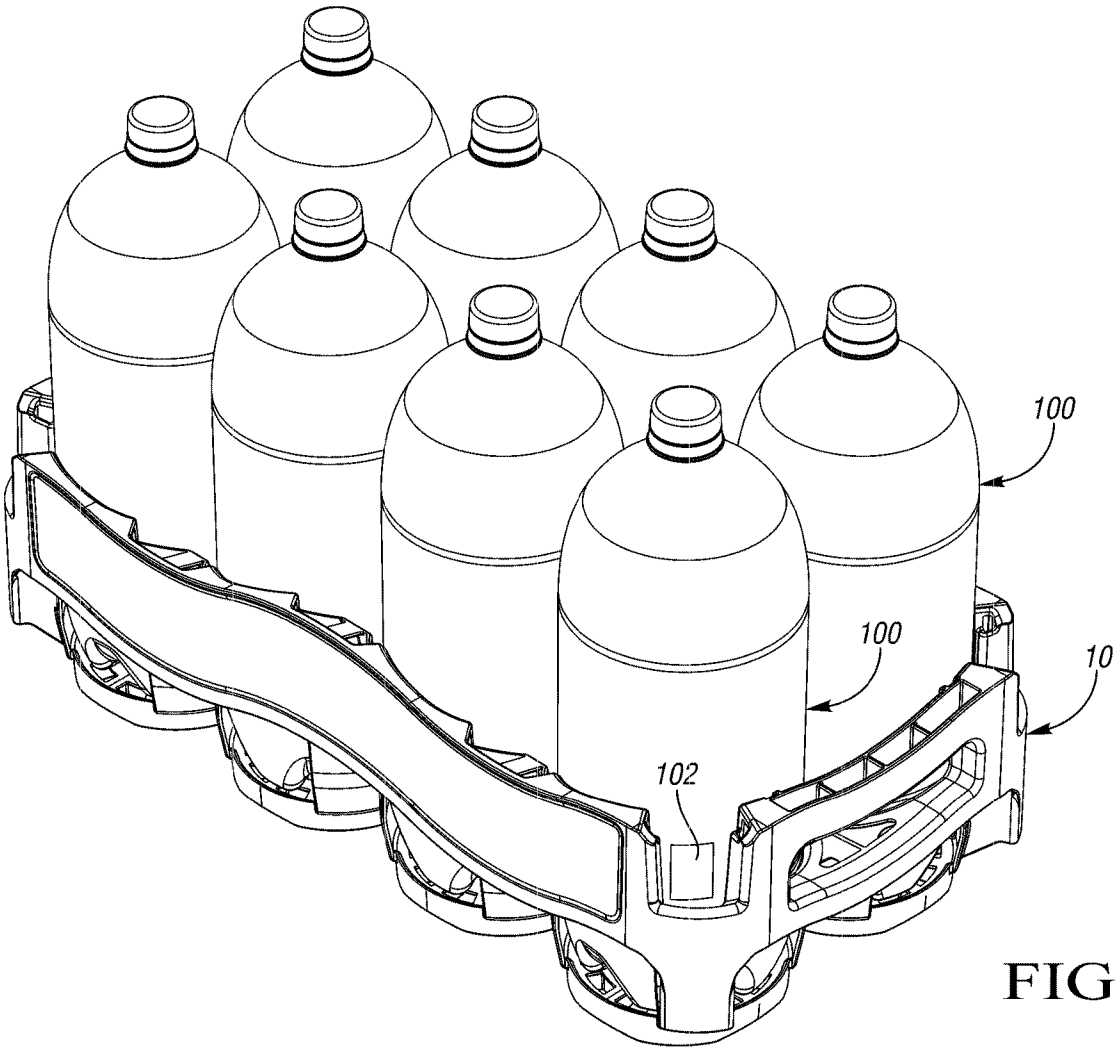
FIG. 10 is a perspective view of the crate with a plurality of bottles received therein.
Figure 11:
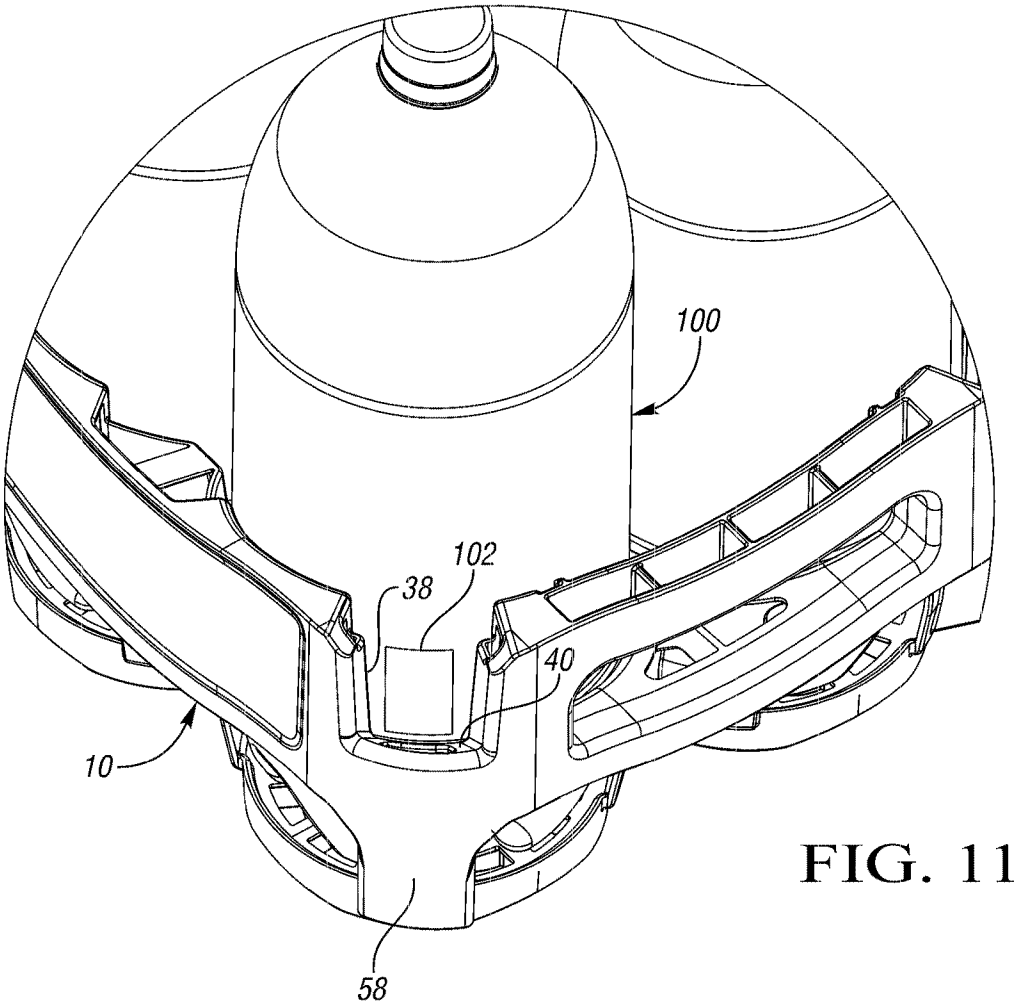
FIG. 11 is an enlarged view of one corner of the crate of FIG. 10 and one of the bottles.

FIG. 10 is a perspective view of the crate 10 with a plurality of bottles 100 received therein. As shown, the bottles 100 have an optical code 102, such as a barcode. As shown in FIG. 11, the code 102 is visible through the upper window 38, which would otherwise be below the upper edges of the side bands 24 or behind the end walls 16. The lower wall 40 is angled downward into the crate 10 to ensure that the entire code 102 is visible while maintaining as much structure in the corner as possible. The bottom of the code 102 is below the outermost edge of the lower wall 40 (and below the uppermost edge of the outer wall 58), but above the inner edge of the lower wall 40 and therefore visible. Thus, a user (such as a store employee) can scan the code 102 with a barcode reader without removing the bottle 100 from the crate 10.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A crate comprising:

a base;

an end wall extending upward from the base;

a side wall extending upward from the base, the side wall and the end wall including an upper band connected to the base by a plurality of columns, the upper band including at least one upper window formed therethrough, the upper window including a lower wall angled downward into the crate, the lower wall extending from an outermost wall of the crate to an interior wall partially defining an interior of the crate.

2. The crate of claim 1 wherein the upper window is aligned with a first column of the plurality of columns.

3. The crate of claim 2 wherein the first column includes an outer wall extending downward from an outer edge of the lower wall and lateral walls extending downward from lateral edges of the lower wall.

4. The crate of claim 3 wherein the lateral walls and outer wall are configured such that the lateral walls and outer wall of an identical crate would be received in the upper window of the crate when the identical crate is nested in the crate.

5. The crate of claim 3 wherein the first column is a corner column.

6. The crate of claim 5 wherein the lateral walls angle downward of the crate as the lateral walls extend from the outer wall toward an inner wall.

7. The crate of claim 1 wherein the upper band includes an upper edge having a curved center peak, troughs on either side of the center peak and end peaks at either end of the side wall.

8. The crate of claim 7 wherein a lower edge of the upper band is complementary to the upper edge.

9. The crate of claim 8 wherein the center peak is higher than the end peaks.

10. The crate of claim 9 wherein the side wall is a first side wall, the crate further including a second side wall that is substantially a mirror image of the first side wall.

11. The crate of claim 8 wherein the end wall includes a curved, concave upper surface.

12. The crate of claim 11 wherein the end wall includes an upper handle portion having a curved, convex lower surface and the curved concave upper surface.

13. The crate of claim 1 wherein the end wall includes an upper handle portion having a curved convex lower surface curving generally in the plane of the end wall.

* * * * *